US008960846B2

(12) United States Patent
Dim

(10) Patent No.: US 8,960,846 B2
(45) Date of Patent: Feb. 24, 2015

(54) PRINTER AND METHOD FOR INKJET PRINTING ON A FLEXIBLE SUBSTRATE

(75) Inventor: Yuval Dim, Moshav Haniel (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 45 days.

(21) Appl. No.: 13/546,671

(22) Filed: Jul. 11, 2012

(65) Prior Publication Data

US 2014/0015885 A1 Jan. 16, 2014

(51) Int. Cl.
*B41J 29/393* (2006.01)

(52) U.S. Cl.
USPC ..... 347/19; 347/5; 347/9; 347/12; 347/13; 347/14; 347/16; 347/101; 347/104

(58) Field of Classification Search
None
See application file for complete search history.

(56) References Cited

U.S. PATENT DOCUMENTS

| | | | | |
|---|---|---|---|---|
| 7,444,862 | B2 | 11/2008 | Innala et al. | |
| 2008/0056788 | A1 | 3/2008 | Okutsu | |
| 2010/0054840 | A1 | 3/2010 | Nouhant et al. | |
| 2010/0123752 | A1 * | 5/2010 | Eun et al. | 347/19 |
| 2013/0321513 | A1 * | 12/2013 | Chen et al. | 347/19 |

FOREIGN PATENT DOCUMENTS

| | | | |
|---|---|---|---|
| JP | 9123425 | A | 5/1997 |
| JP | 2004306363 | A | 11/2004 |
| WO | WO-2006036018 | A1 | 4/2006 |

OTHER PUBLICATIONS

Brown, M.; "Efficient Printing of Flexible Substrates"; Sep. 1, 2008; http://www.emasiamag.com/article-4270-efficientprintingof-flexiblesubstrates-Asia.html.

* cited by examiner

*Primary Examiner* — Justin Seo
(74) *Attorney, Agent, or Firm* — Samson & Partner; Wolfgang Lippich

(57) ABSTRACT

A printer for inkjet printing on a flexible substrate. It has a print-head for printing on the flexible substrate in a printing area, and a transport and tensioning mechanism for transporting the flexible substrate in a feed direction relative to the printing area and applying tension to it. The tension applied to the flexible substrate causes a substrate elongation. The printer is arranged to measure the substrate elongation caused by the tension applied to the flexible substrate and compensate for the substrate elongation by at least one of modifying the defined transport of the flexible substrate, and translating the print-head relative to the printing area.

19 Claims, 6 Drawing Sheets

PRINTER AND METHOD FOR INKJET PRINTING ON A FLEXIBLE SUBSTRATE

SUMMARY OF THE INVENTION

Examples of the present invention provide a printer for inkjet printing on a flexible substrate which inkjet printer comprises a print-head for printing on the flexible substrate in a printing area, and a transport mechanism for transporting the flexible substrate in a feed direction along a feed-path relative to the printing area, the transport mechanism including a substrate drive-roll and a substrate tension-providing-roll, both being separated by a gap which includes the printing area, wherein the substrate drive-roll provides for a defined transport of the flexible substrate relative to the printing area, and the substrate tension-providing-roll applies a defined tension to the flexible substrate relative to the substrate drive-roll, wherein the tension applied to the flexible substrate causes a substrate elongation in the direction parallel to the feed direction. The printer is arranged for measuring the substrate elongation caused by the tension applied to the flexible substrate by the transport mechanism between the substrate drive-roll and the substrate tension-providing-roll, and compensating for the substrate elongation by at least one of: modifying the defined transport of the flexible substrate relative to the printing area, and translating the print-head relative to the printing area in the direction parallel to the feed direction of the flexible substrate.

BRIEF DESCRIPTION OF THE DRAWINGS

Examples will now be described, by way of example only, with reference to the accompanying drawings in which corresponding reference numerals indicate corresponding parts and in which.

The drawings and the description of the drawings are of examples of the invention and not of the invention itself.

DETAILED DESCRIPTION OF EMBODIMENTS

Figure 1:
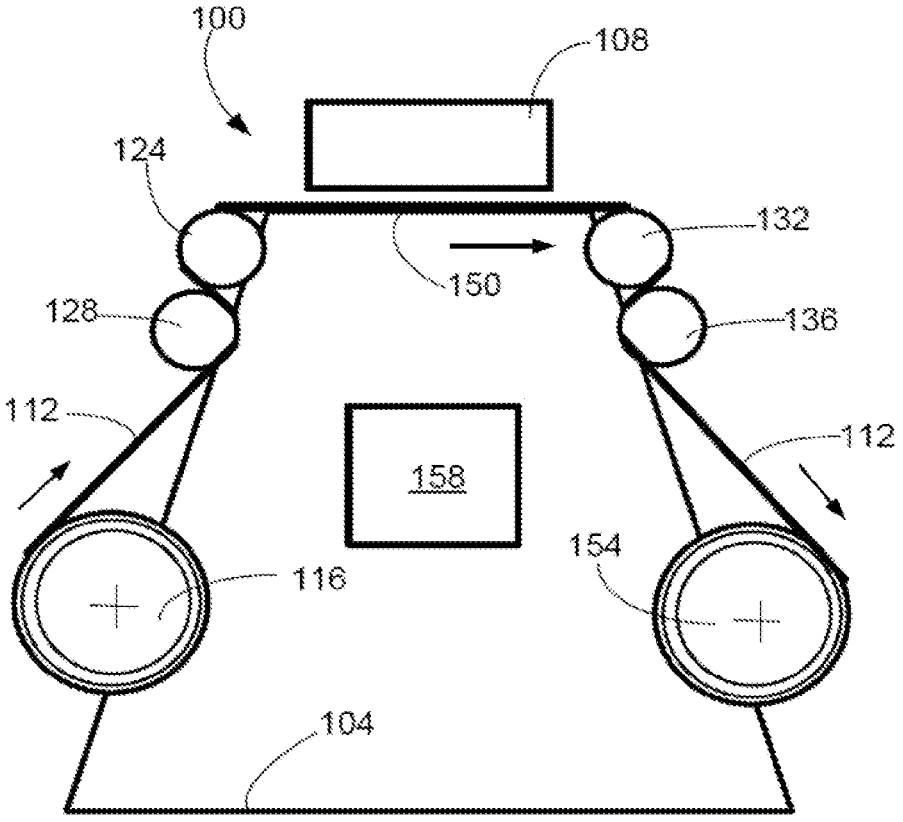
FIG. 1 is a schematic illustration of the side view of an inkjet printer which may be a wide format printer.

FIG. 1 is a schematic illustration of a printer in the form of a wide format printer. Printer 100 includes a rigid frame 104 on which a print-head 108 is arranged for moving in a reciprocating type of movement across a flexible substrate 112. Typically, this reciprocating movement, which often is referred to as swathing, is in a direction perpendicular to the drawing plane of FIG. 1. UV radiation sources for ink curing or ink drying sources may be attached to or near the print head 108 and may move in the same reciprocating movement as the print head 108 or may have separate drives or, may also be stationary.

Mounted on the frame 104 are components of a feed-path for the flexible substrate 112 which include a substrate supply-roll 116, a substrate drive-roll 124 and, associated with the substrate drive-roll 124, a first or drive-roll pressure-roll 128. Spaced apart from the drive-roll 124, there is arranged a substrate tension-providing-roll 132 and, associated with the substrate tension-providing-roll 132, a second pressure-roll 136. The drive-roll 124, the first pressure roll 128, the tension-providing-roll 132 and the second pressure-roll 136 span at least the width of the substrate 112 on which printing is performed. For example, in the case of a wide format printer, the substrate may be 5 meters (5000 mm) wide and the rolls 124, 128, 132 and 136 will be of a similar length. Since the rolls are relatively long, each of them or some of them may be supported by a series of clamping rolls for applying a support force directly to the surface of the rolls through a rolling contact.

Also shown in FIG. 1 is a support surface 150 for the flexible substrate 112. This support surface 150 is a flat surface, although it also may be a curved surface, or a surface assembled from separate segments, over which printing takes place and which includes a printing area on which printing is performed by the print-head 108. The support surface 150 is located in a space between the drive-roll 124 and the tension-providing-roll 132.

The substrate 112, after having been printed, may be collected on a collection-roll 154, or it may be collected as a free-fall substrate.

The printer 100 further includes a control unit 158 which is arranged for controlling the rotation speed of all rolls, the operation of the UV radiation sources or drying heat emitting sources, synchronisation of all the units, and, of course, the printing process itself, i.e. receiving, processing and generating image-representing data and forwarding them to the print-head 108.

The substrate 112, as a web, is threaded through the substrate feed-path from the substrate supply-roll 116, on which the substrate 112 is stored, through the first pressure-roll 128 and the substrate drive-roll 124 and over the support surface 150 where the printing takes place in the printing area. In operation, the substrate drive-roll 124 is caused to rotate at a first speed, and the tension-providing-roll 132 is caused to rotate at a second, different, speed which is higher than the first rotation speed, and the difference in the rotation speed of the two rolls 124, 132 generates a constant tension (back tension) as a force which keeps the substrate 112 flat in a section of a web of substrate 112 located between the spaced apart drive-roll 124 and tension-roll 132 and including the printing area on the support surface 150. The web of substrate 112 is pulled over the support surface 150 past the tension-providing-roll 132 and the second pressure-roll 136, as shown by the arrow in FIG. 1, towards the substrate collection-roll 154.

In the course of printing, at each pass or stroke of the print-head 108, the substrate 112 is advanced in a step-wise manner wherein the step typically is equal to the width at each stroke or pass of the print-head 108. The surface 150 located between the tension-providing-roll 132 and the substrate drive-roll 124 supports the tensioned web of substrate 112 in the printing area. However, because of the tension force applied to the flexible substrate 112 between the rolls 124 and 132, the substrate 112 changes in dimension, which means, typically, it stretches in the direction towards the roll 132.

Figure 1A:
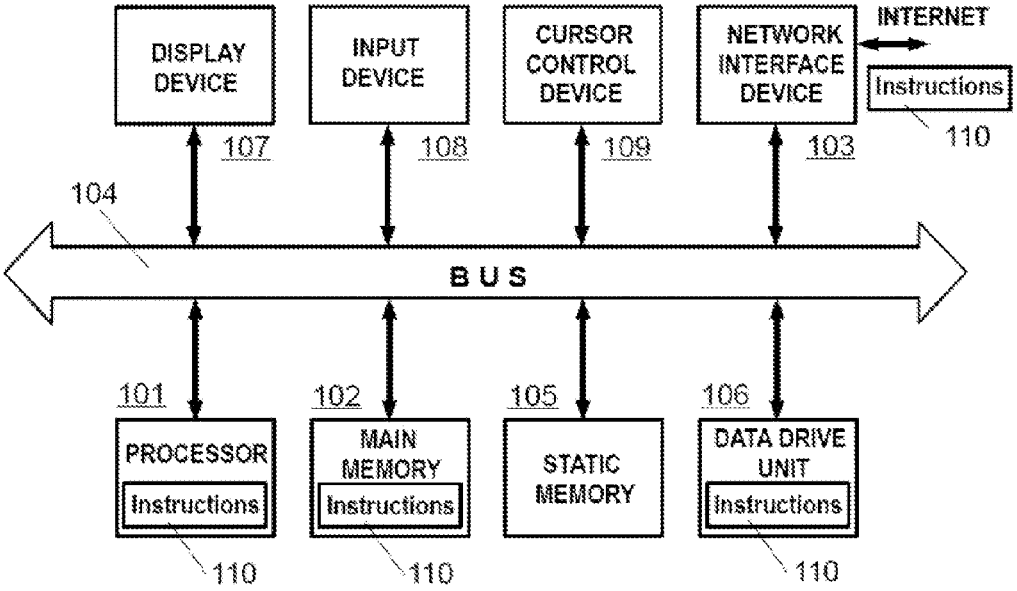
FIG. 1*a* is a diagrammatic representation of a computer system as it may be arranged to provide the functionality of a controller implemented in the printer.

FIG. 1*a* is a diagrammatic representation of a computer system as it may be arranged to provide the functionality of the controller 158 in FIG. 1 or in the later described FIGS. 3, 5 and 6. The computer system is configured to execute a set of instructions so that the controller 158 is able to perform the described tasks for the printer. The computer system includes a processor 101 and a main memory 102, which communicate with each other via a bus 104. Optionally, the computer system may further include a static memory 105 and/or a non-transitory memory 106 which may be a solid state memory or a disk-drive unit. A video display 107, an alpha-numeric input device 108 and a cursor control device 109 may form a user interface. Additionally, a network interface device 103 may be provided to connect the computer system to an intranet or to the Internet. A set of instructions (i.e. software) 110 embodying any one, or all, of the controller tasks described herein, may reside completely, or at least partially, in or on a machine-readable medium, e.g. the main memory 102 and/or the processor 101. A machine-readable medium on which the software 110 resides may also be a data carrier 111 (e.g. a solid state data drive, a non-removable magnetic hard disk or an optical or magnetic removable disk) which is part of the data drive unit 106.

Figure 2:
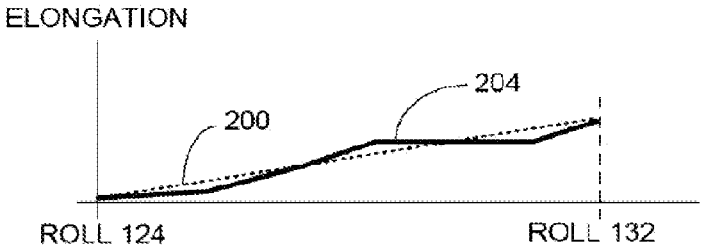
FIG. 2 is a diagram illustrating elongation of a flexible substrate under tension in a printer.

FIG. 2 is a diagram which shows elongation of the substrate 112 under the tension force in a wide-format printer. Line 200 shows the theoretical elongation, whereas line 204 shows the actual elongation of the substrate 112. If the substrate 112 elongation were indeed linear, it would be easy to compensate for the elongation by introducing a fixed correction for each subsequent stroke or pass of the print-head 108 in the reciprocating or swathing movement. In practice, however, as shown by line 204, the actual substrate elongation will change from stroke to stroke. The variability is caused by mechanical system imperfections, non-homogeneity of the substrate 112, by drastic temperature changes of the substrate 112 caused by the curing radiation or heat-emitting sources, or for other reasons.

The width of a stroke of the print-head 108 in the direction of advance of the substrate 112 is typically equal to the print-head assembly width and has a constant value. When the value of the substrate 112 advance does not match the print head 108 stroke, artefacts in the form of wide strips or of marginally overlapping strips are formed in the printed image.

Figure 3:
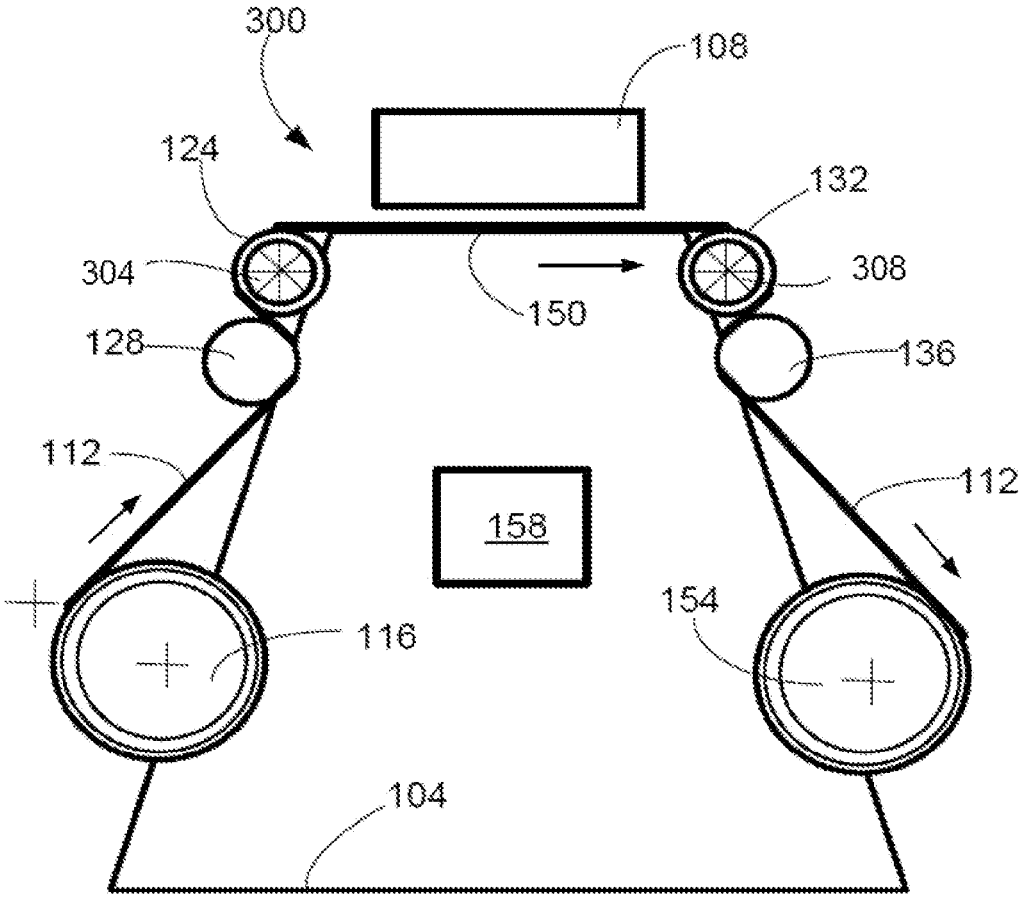
FIG. 3 is a schematic illustration of the side view of a printer according to one embodiment.

FIG. 3 is a schematic illustration of a side-view of an exemplary wide format printer.

In general, the printer 300 which is adapted for inkjet printing on a flexible substrate 112 includes a print-head 108 which is adapted for printing on the flexible substrate 112 in a printing area which is on a support surface 150. For transporting the flexible substrate 112 in a feed direction, as indicated by the arrows, along a feed-path and relative to the printing area 150, a transport mechanism is provided which includes a substrate drive-roll 124 and a substrate tension-providing-roll 132. The substrate drive-roll 124 and the substrate tension-providing-roll 132 are separated by a distance or a gap that includes the printing area 150. The substrate drive-roll 124 provides for a defined transport of the flexible substrate 112 relative to the printing area 150, and the substrate tension-providing-roll 132 applies a defined tension to the flexible substrate 112 relative to the substrate drive-roll 124. The tension applied to the flexible substrate 112 causes an elongation of the substrate in the direction parallel to the feed direction.

In FIG. 3, the substrate drive-roll 124 is arranged, with regard to the advance or transport direction of the flexible substrate 112 as indicated by the arrows, upstream of the substrate tension-providing-roll 132, but, the arrangement also may be vice-versa, i.e. the substrate drive-roll 124 being arranged downstream of the tension-providing-roll 132. This alternative configuration also applies to the other examples described here.

In the same way as shown for the printer 100 illustrated in FIG. 1, the printer 300 includes a rigid frame 104 on which the print-head 108 is arranged to move in a reciprocating or swathing type of movement, which may be on linear guiding tracks. UV ink curing radiation sources or ink drying sources may be arranged near or attached to the print-head 108 and they may move in the same reciprocating movement as the print-head 108 or they may have separate drives or may be stationary.

Mounted on the frame 104 are components of the substrate 112 feed-path including a substrate supply roll 116, on which the substrate 112 is stored, the substrate drive-roll 124 and, associated with it, a first or drive-roll pressure-roll 128, similar to the printer 100 of FIG. 1. Spaced apart from the drive-roll 124 there is the substrate tension-providing-roll 132 and, associated with it, a second pressure-roll 136, also similar to the printer 100 of FIG. 1.

Referring again to FIG. 3, the drive-roll 124, the first pressure-roll 128, the tension-providing-roll 132 and the second pressure-roll 136 span at least the width of the substrate 112 on which printing is to be performed. The rolls are generally parallel to each other and span at least the width of the substrate on which printing is to be performed. For example, the substrate may be about 5 meters (5000 mm) wide and the rolls 124, 128, 132 and 136 will be of a similar length. Since the rolls are relatively long, each or some of the pressure rolls 128, 136 may be supported by a series of clamping rolls for applying a support force directly to the surface of the rolls through a rolling contact.

As in the printer of FIG. 1, the printer of FIG. 3 has a support surface 150 for the flexible substrate 112. This support surface 150 is a flat surface, although it may be a curved surface, or a surface assembled from separate segments, over which printing takes place and which includes a printing area on which printing is performed by the print-head 108. The support surface 150 is located in a space between the drive-roll 124 and the tension-providing-roll 132.

The substrate 112, after having been printed, may be collected on a collection-roll 154, or it may be collected as a free-fall substrate.

The printer 300 further includes a control unit 158 which is arranged for controlling the rotation speed of all the rolls, the operation of the UV radiation sources or drying heat emitting sources, synchronisation of all the units, and, of course, the printing process itself, i.e. processing image representing data and forwarding them to the print-head 108.

The substrate 112, as a web, is threaded through the substrate feed-path from the substrate supply-roll 116 on which the substrate 112 is stored through the first pressure-roll 128 and the substrate drive-roll 124 over the support surface 150, as shown by the arrow, where the printing takes place in the printing area. In operation, the substrate drive-roll 124 is caused to rotate at a first speed, and the tension-providing-roll 132 is caused to rotate at a second, different, speed, which is higher than the first rotation speed, and the difference in the rotation speed of the two rolls 124, 132 generates a constant tension (back tension) as a force which keeps the substrate 112 flat in a section of a web of substrate 112 located between the drive-roll 124 and tension-roll 132 and including the printing area on the support surface 150. The web of substrate 112 is pulled over the support surface 150 past the tension-providing-roll 132 and the second pressure valve 136 towards the substrate collection-roll 154.

In the course of printing, at each pass or stroke of the print-head 108, the substrate 112 is advanced in a step-wise manner wherein the step typically is equal to the width at each stroke or pass of the print-head 108. The surface 150 located between the tension-providing-roll 132 and the substrate drive-roll 124 supports the tensioned web of substrate 112 in the printing area.

However, because of the tension force applied to the flexible substrate 112 between the rolls 124 and 132, the substrate 112 changes in dimension, which means, typically, it stretches in the direction towards the roll 132.

The printer 300 of FIG. 3, in general, is arranged for measuring the substrate elongation caused by the tension applied to the flexible substrate by the transport mechanism, and for compensating the substrate elongation by modifying the defined transport of the flexible substrate relative to the printing area 150.

In the example shown in FIG. 3, for measuring the substrate elongation caused by the tension applied to the flexible substrate between the substrate drive-roll 124 and the substrate tension-providing-roll 132, encoders 304 and 308 are provided which are coupled to the rolls 124 and 132, respectively. The encoders 304 and 308 are arranged for measurement and comparison of the length of the substrate 112 metered by the roller 124 and the roller 132.

The control unit 158 is arranged to compute a value representing the substrate elongation caused by the tension applied to the flexible substrate 112 by the transport mechanism, and to output a control signal for compensating the substrate elongation by at least one of modifying the defined transport of the flexible substrate relative to the printing area 150 and translating the print-head relative to the printing area in the direction parallel to the feed direction of the flexible substrate. The measurements of the encoders 304 and 308 are output to the control unit 158 where a difference in the advance of the substrate 112 is computed on the basis of the measurements by the encoders 304 and 308, so that a value which represents the substrate elongation is provided.

A substrate elongation as caused by the tension applied to the flexible substrate 112 by the transport mechanism between the substrate drive-roll 124 and substrate tension-providing-roll 132 is compensated on the basis of the actual value as computed by the control unit 158 in response to the measurements of the encoders 304 and 308 by modifying the defined transport of the flexible substrate 112 relative to the printing area 150, which, according to one embodiment, is carried out by modifying the substrate advance, i.e. the substrate advance rate, by the substrate drive-roll 124.

In the example shown, the substrate drive-roll 124 is arranged upstream of the substrate tension-providing-roll 132 with regard to the printing area 150. But, as already noted above, the substrate drive-roll 124, generally, can also be arranged downstream of the substrate tension-providing-roll 132.

Figure 5:
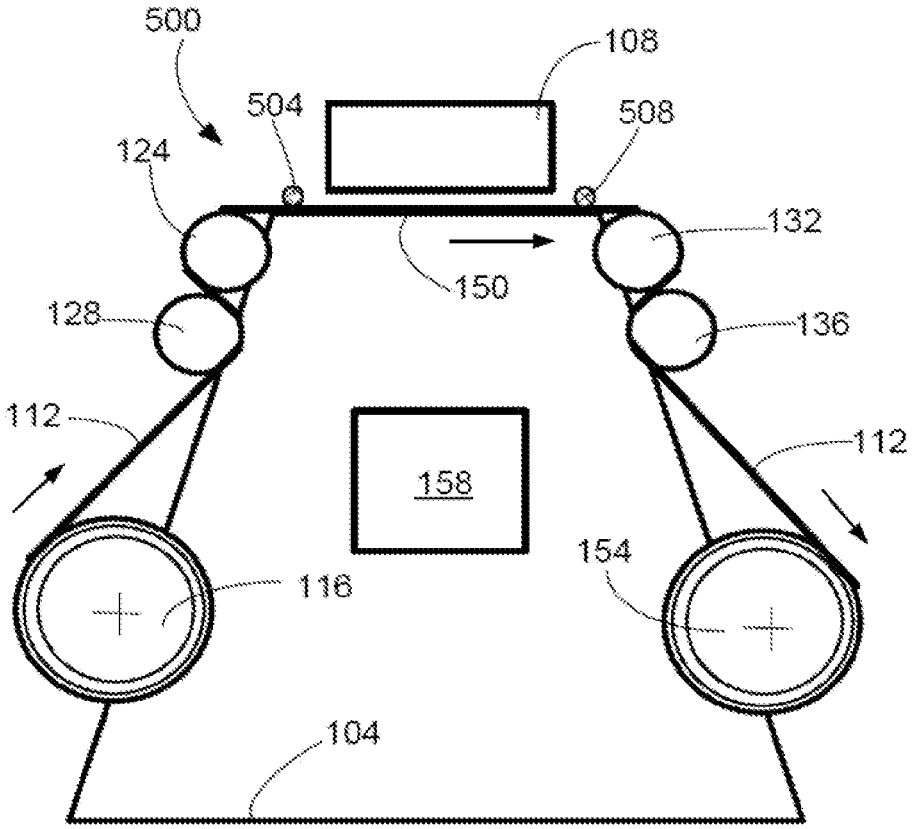
FIG. 5 is a schematic illustration of the side view of a printer according to another embodiment.

FIG. 5 is a schematic illustration of the side-view of a printer according to another embodiment. In FIG. 5 corresponding reference numerals refer to corresponding parts as in the FIGS. 1 and 3. The printer 500 includes two substrate length-metering rolls 504 and 508 which are connected to length-metering rolls which are associated with the substrate drive-roll 124 and the substrate tension-providing-roll 132, respectively, and which measure elongation of the substrate 112 in the printing zone or area 150. The correction of the substrate movement may be performed in a similar way to that described above with reference to FIG. 3.

Figure 4:
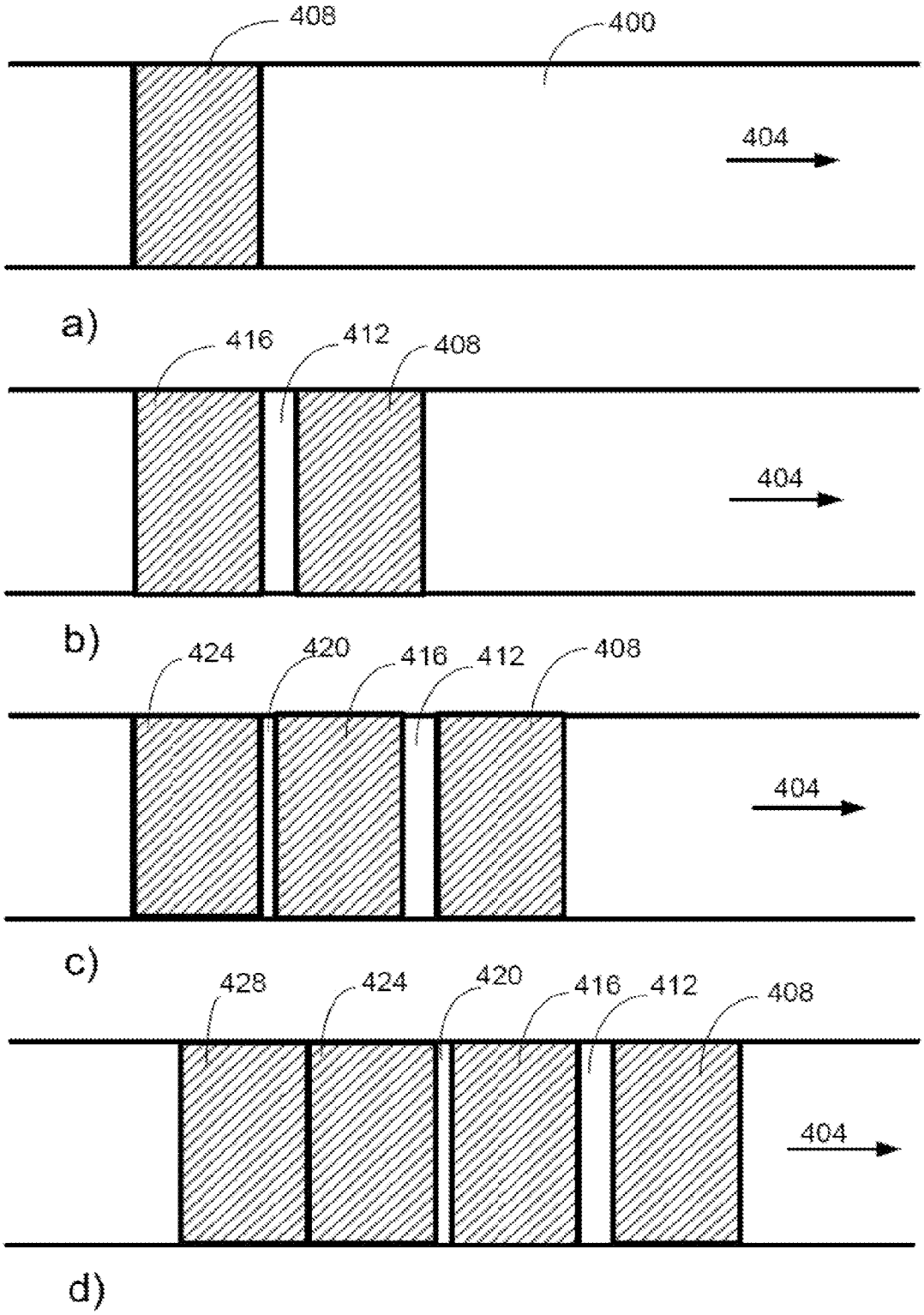
FIG. 4 is as schematic illustration for explaining an example of operation of a printer.

FIG. 4 is an exemplary schematic illustration of the operation of the present printer. As shown in FIG. 4*a*, the substrate 400 is pulled in the direction of arrow 404 by the transport mechanism. The print-head prints a first pass image 408 across the substrate 400. Upon completion of printing the first pass image 408, the substrate 400 is advanced in the direction of arrow 404 on a step which is nominally equal to the printed image width.

The compensation for the substrate elongation caused by the tension applied to the flexible substrate 400 by the transport mechanism of the printer is compensated by modifying the defined transport of the flexible substrate 400 relative to the printing area 150. One possible method of compensating for the substrate elongation is to meter the substrate advance simultaneously by both encoders 304 and 308, or 504 and 508, and to discontinue the substrate advance when both encoders provide identical substrate readings. This ensures that, regardless of the substrate elongation, the substrate segment between the two encoders 304, 308; 504, 508 has the same length, although the tension applied to the substrate segment may be different.

Owing to substrate elongation and mechanical errors of the elements forming the substrate feed-path, i.e. the rolls 128, 124, 132, 136 in FIG. 3, a gap 412 may be formed between the first printed image 408 and a successive next printed image 416, as shown in FIG. 4*b*. The encoders 304 and 308 measure the length of the substrate 400 and enable determination of the elongation or gap 412 of the substrate 400.

According to another example, the substrate length metered by both encoders 304, 308; 504, 508 is averaged and compared to a desired or target substrate advance.

For printing the next pass image 424, FIG. 4*c*, the substrate 400 is pulled on a length that is smaller (in the present example) than the print head 108 width. This reduces the width of a gap 420 between the consecutive pass images 416 and 424. An iterative process of substrate advance averaging and gap reduction continues until a gap between successive images, for example, images 424 and 428 in FIG. 4*d* is reduced to a value that does not affect/impair image quality.

It is noted that when a new roll of substrate is loaded on the substrate supply-roll 116, the length of the substrate 112 available for printing is known. The encoder 304 in FIG. 3, and the encoder 504 in FIG. 5, respectively, associated with the roll 124 provides an accurate reading of the length of the substrate 112 pulled out from the substrate supply roll 116 and enables an accurate estimation of the remaining substrate length, which is an additional advantage.

Figure 6:
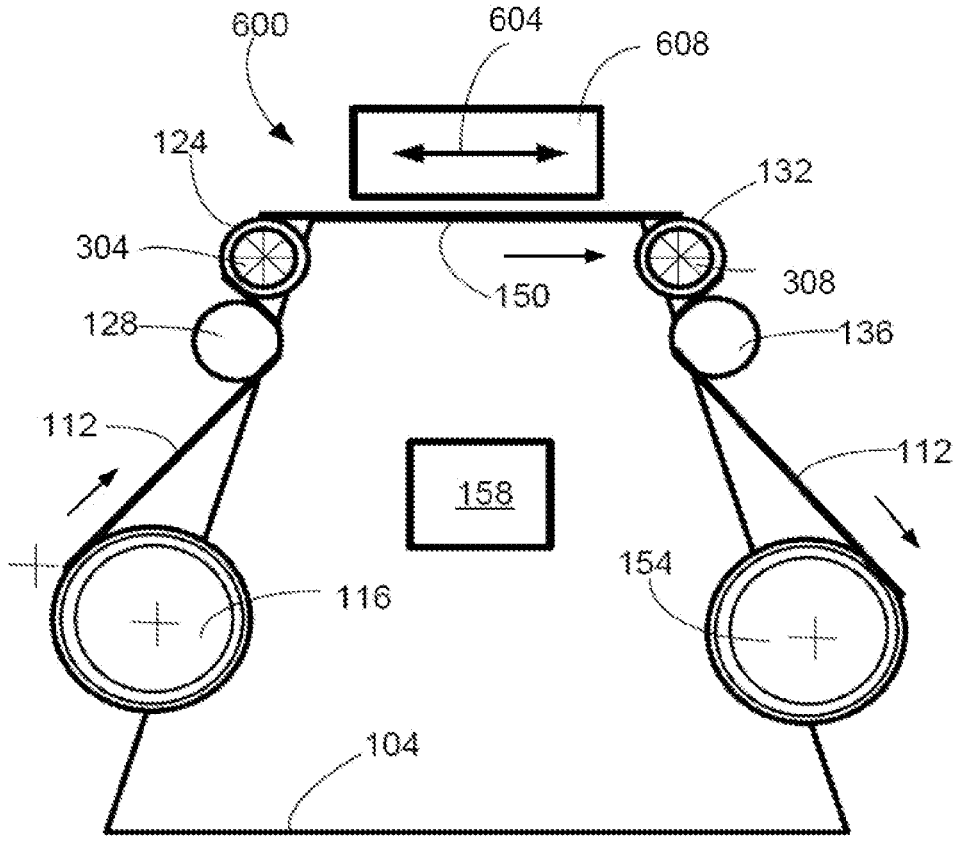
FIG. 6 is a schematic illustration of the side view of a printer according to still another embodiment.

Now referring to FIG. 6, which shows a schematic illustration of the side-view of a printer according to still another example. The printer 600 includes a print head 608 that is capable, in addition to its reciprocating movement during the image printing passes, of being translated by a print-head displacement unit, as schematically indicated by arrow 604, in a direction parallel to the substrate advance direction. As in the other embodiments, the expression "in the direction parallel to the feed direction" also here includes both senses of direction, i.e. parallel or antiparallel to the feed direction.

The printer 600 of FIG. 6 also includes a control unit 158 which is arranged to compute a value representing the substrate elongation caused by the tension applied to the flexible substrate 112 by the transport mechanism, and to output a control signal for compensating the substrate 112 elongation by at least one of modifying the defined transport of the flexible substrate relative to the printing area 150 and translating the print-head 608 relative to the printing area 150 in the direction parallel to the feed direction of the flexible substrate 112. The print-head 608 is arranged to be (able to be) translated in a direction parallel to the substrate 112 advance direction in response to the control signal output from the control unit 158.

The substrate elongation as metered by encoders 304 and 308 of FIG. 3, or by length-metering rolls 504 and 508, as in FIG. 5, enables a gap-value determination. The gap value may be fed to the controller 158 which will issue a command displacing the print head 604 on the gap value in a desired direction compensating for the gap width, as explained with reference to FIG. 4. Accurate knowledge of a particular incremental substrate elongation supports better artefacts compensation.

Referring again to the examples described with reference to FIGS. 3 and 5, the compensation of the substrate elongation, in accordance with other examples, can also be done by changing the substrate tension which is exerted on the substrate 112 by the substrate tension-providing-roll 132.

Further, two or more of the described measures for compensating the substrate elongation may be combined, i.e. the substrate elongation can be compensated for by at least one of modifying the defined transport of the flexible substrate relative to the printing area by changing the value of substrate advance, by changing the substrate tension, and by translating the print-head relative to the printing area in the direction parallel to the feed direction of the flexible substrate 112.

The printer described above reduces substrate waste, improves print quality, and the real time correction is substrate independent. The method also enables use of low cost substrates with non-stable mechanical properties.

Some more general points of examples as described herein will be discussed:

Inkjet printing can be used for the printing of billboards, banners and point of sale displays, etc. The ink jet printing process involves manipulation of drops of ink ejected from an orifice or a number of orifices of a print-head onto on an adjacent print substrate. Paper, vinyl, textiles, fabrics and others are examples of print substrates. Relative movement between the substrate and the print-head enables ink coverage of the substrate and image creation. Billboards and banners having relatively large dimensions may be printed on flexible substrates. Such substrates represent rolls of flexible material that, for example, are up to 5 meters wide.

Printing on flexible substrates, for example, may be performed by Roll-to-Roll (R2R) printing machines. In a R2R printer transportation of the substrate is carried out by a number of rolls which form a substrate feed-path. Some of the rolls induce the substrate movement and others induce tension of the substrate or change the substrate direction between the rolls involved in substrate movement.

The print-head, for example, may pass in a reciprocating or swathing movement over the recording substrate in a printing zone or region, and print a section of an image at each pass. After each reciprocating movement or pass, the substrate is moved further to a position where the next section of a desired image may be printed on it in a similar reciprocating or swathing movement. A solid flat, or also curved, surface may be located in the printing zone or region between the rolls. For example, the surface supports the printing substrate and is supposed to keep it flat, e.g. in the printing zone or region of the substrate feed-path.

Additionally, the recording substrate may be tensioned by a tension mechanism at one of its ends so as to keep it flat when the substrate spans over the support surface of the printing zone or region. The term "tension" may refer to a force that keeps the substrate tensioned with respect to one of the rolls in the substrate feed-path. A difference in rotational speed between two or more rolls in the substrate path typically generates the tension. Since the substrate is flexible, the tension stretches the substrate dimension in the printing zone. Substrate elongation is not always proportional to the tensioning force and homogeneity of the substrate, and since the substrate is pulled in a step-wise manner on a constant step value, print artefacts tend to appear in the printed image.

With the exemplary printers for inkjet printing on a flexible substrate substrate elongation caused by tension applied by a transportation mechanism for transporting the flexible substrate in a feed direction is compensated. Expressions like "in the direction parallel to the feed direction" include both senses of direction, i.e. parallel or antiparallel to the feed direction.

An exemplary printer is arranged to compensate for the substrate elongation by modifying the defined transport of the flexible substrate relative to the printing area by changing the value of substrate advance, i.e. the advance rate, in the direction parallel to the feed direction of the flexible substrate.

Another exemplary printer is arranged to compensate for the substrate elongation by modifying the defined transport of the flexible substrate relative to the printing area by changing the substrate tension, i.e. the tension force, in the direction parallel to the feed direction of the flexible substrate.

The two points mentioned above may also be combined. That means that the printer may be arranged to compensate for the substrate elongation by modifying the defined transport of the flexible substrate relative to the printing area by changing the value of substrate advance in the direction parallel to the feed direction of the flexible substrate and by changing the substrate tension in the same direction.

In some examples the printer includes a control unit which is arranged to compute a value representing the substrate elongation caused by the tension applied to the flexible substrate by the transport mechanism, and to output a control signal for compensating the substrate elongation by at least one of modifying the defined transport of the flexible substrate relative to the printing area and translating the print head relative to the printing area in the direction parallel to the feed direction of the flexible substrate.

According to one example, the printer may include first and second encoders for measuring the substrate elongation caused by the tension applied to the flexible substrate between the substrate drive-roll and the substrate tension-providing-roll. These first and second encoders which are coupled to the substrate drive-roll and to the substrate tension-providing-roll, respectively, or first and second encoders which are coupled to first and second length-metering rolls which are associated with the substrate drive-roll and the substrate tension-providing-roll, respectively, wherein the first and second encoders are arranged for measurement and comparison of the length of the substrate as metered by the substrate drive-roll and as metered by the substrate tension-providing-roll, respectively, and wherein the measurements of the first and second encoders are output to the control unit where a difference representing a value of substrate elongation in the advance of the substrate between the substrate drive-roll and the substrate tension-providing-roll is computed on the basis of the measurements provided by the first and second encoders.

The exemplary printer may also be arranged to compensate the substrate elongation (caused by the tension applied to the flexible substrate by the transport mechanism between the substrate drive-roll and substrate tension-providing-roll and computed by the control unit on the basis of the actual value in response to the measurements of the first and second encoders) by changing the substrate advance as applied by the substrate drive-roll for modifying the defined transport of the flexible substrate relative to the printing area.

Alternatively or additionally, the printer may be arranged to compensate the substrate elongation (caused by the tension applied to the flexible substrate by the transport mechanism between the substrate drive-roll and substrate tension-providing-roll and computed by the control unit on the basis of the actual value in response to the measurements of the first and second encoders) by changing the substrate tension as applied by the substrate tension-providing-roll for modifying the defined transport of the flexible substrate relative to the printing area.

The substrate drive-roll may be arranged upstream of the substrate tension-providing-roll with regard to the printing area. Alternatively, the substrate drive-roll also may be arranged downstream of the substrate tension-providing-roll with regard to the printing area.

According to another example, the printer is arranged to compensate for the substrate elongation by translating the print-head relative to the printing area in the direction parallel to the feed direction of the flexible substrate. Here, too, it should be noted that the expression "in the direction parallel to the feed direction" includes both senses of direction, i.e. parallel or antiparallel to the feed direction.

According to one example, the printer includes a control unit which is arranged to compute a value representing the substrate elongation caused by the tension applied to the flexible substrate by the transport mechanism, and to output a control signal for compensating the substrate elongation by at least one of modifying the defined transport of the flexible substrate relative to the printing area and translating the print-head relative to the printing area in the direction parallel to the feed direction of the flexible substrate, and wherein the printer includes a print-head which is arranged to be able to be translated in a direction parallel to the substrate advance direction in response to the control signal output from the control unit.

According to another example, the printer includes first and second encoders which are coupled to the substrate drive-roll and to the substrate tension-providing-roll, respectively, for measuring the substrate elongation caused by the tension applied to the flexible substrate between the substrate drive-roll and the substrate tension-providing-roll. Alternatively, the printer may include first and second encoders which are coupled to first and second length-metering rolls which are associated with the substrate drive-roll and the substrate tension-providing-roll, respectively, wherein the first and second encoders are arranged for measurement and comparison of the length of the substrate as metered by the substrate drive-roll and as metered by the substrate tension-providing-roll, respectively, and wherein the measurements of the first and second encoders are output to the control unit where a difference representing a value of substrate elongation in the advance of the substrate between the substrate drive-roll and the substrate tension-providing-roll is computed on the basis of the measurements provided by the first and second encoders, and wherein the control unit is arranged to issue a command displacing the print-head in a desired direction compensating for the substrate elongation caused by the tension applied to the flexible substrate.

Although certain products and methods constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed:

1. A printer for inkjet printing on a flexible substrate, which inkjet printer comprises:

a print-head for printing on the flexible substrate in a printing area, and a transport mechanism for transporting the flexible substrate in a feed direction along a feed-path relative to the printing area, the transport mechanism including a substrate drive-roll and a substrate tension-providing-roll, both being separated by a distance which includes the printing area, wherein the substrate drive-roll provides for a defined transport of the flexible substrate relative to the printing area, and the substrate tension-providing-roll applies a defined tension to the flexible substrate relative to the substrate drive-roll, wherein the tension applied to the flexible substrate causes a substrate elongation in the direction parallel to the feed direction, wherein the printer is arranged for measuring the substrate elongation caused by the tension applied to the flexible substrate by the transport mechanism between the substrate drive-roll and the substrate tension-providing-roll, and compensating for the substrate elongation by at least one of modifying the defined transport of the flexible substrate relative to the printing area and translating the print head relative to the printing area in the direction parallel to the feed direction of the flexible substrate, wherein the printer is arranged to compensate for the substrate elongation by translating the print head relative to the printing area in the direction parallel to the feed direction of the flexible substrate.

2. The printer of claim 1, wherein the printer is arranged to compensate for the substrate elongation by modifying the defined transport of the flexible substrate relative to the printing area by changing the value of substrate advance in the direction parallel to the feed direction of the flexible substrate.

3. The printer of claim 1, wherein the printer is arranged to compensate for the substrate elongation by modifying the defined transport of the flexible substrate relative to the printing area by changing the substrate tension in the direction parallel to the feed direction of the flexible substrate.

4. The printer of claim 1, wherein the printer includes a control unit which is arranged to compute a value representing the substrate elongation caused by the tension applied to the flexible substrate by the transport mechanism, and to output a control signal for compensating the substrate elongation by at least one of modifying the defined transport of the flexible substrate relative to the printing area and translating the print head relative to the printing area in the direction parallel to the feed direction of the flexible substrate.

5. The printer of claim 4, wherein the printer includes, for measuring the substrate elongation caused by the tension applied to the flexible substrate between the substrate drive-roll and the substrate tension-providing-roll, first and second encoders which are coupled to the substrate drive-roll and to the substrate tension-providing-roll, respectively, or first and second encoders which are coupled to first and second length-metering rolls which are associated with the substrate drive-roll and the substrate tension-providing-roll, respectively, wherein the first and second encoders are arranged for measurement and comparison of the length of the substrate as metered by the substrate drive-roll and as metered by the substrate tension-providing-roll, and wherein the measurements of the first and second encoders are output to the control unit where a difference representing a value of substrate elongation in the advance of the substrate between the substrate drive-roll and the substrate tension-providing-roll is computed on the basis of the measurements by the first and second encoders.

6. The printer of claim 5, wherein the printer is arranged to compensate the substrate elongation as caused by the tension applied to the flexible substrate by the transport mechanism between the substrate drive-roll and substrate tension-providing-roll on the basis of the actual value as computed by the control unit in response to the measurements of the first and second encoders by changing the substrate advance as applied by the substrate drive-roll for modifying the defined transport of the flexible substrate relative to the printing area.

7. The printer of claim 5, wherein the printer is arranged to compensate the substrate elongation caused by the tension applied to the flexible substrate by the transport mechanism between the substrate drive-roll and substrate tension-providing-roll on the basis of the actual value as computed by the control unit in response to the measurements of the first and second encoders by changing the substrate tension as applied by the substrate tension-providing-roll for modifying the defined transport of the flexible substrate relative to the printing area.

8. The printer of claim 6, wherein the substrate drive-roll is arranged upstream of the substrate tension-providing-roll with regard to the printing area.

9. The printer of claim 6, wherein the substrate drive-roll is arranged downstream of the substrate tension-providing-roll with regard to the printing area.

10. The printer of claim 7, wherein the substrate drive-roll is arranged upstream of the substrate tension-providing-roll with regard to the printing area.

11. The printer of claim 7, wherein the substrate drive-roll is arranged downstream of the substrate tension-providing-roll with regard to the printing area.

12. The printer of claim 1, wherein the printer includes a control unit which is arranged to compute a value representing the substrate elongation caused by the tension applied to the flexible substrate by the transport mechanism, and to output a control signal for compensating the substrate elongation by at least one of modifying the defined transport of the flexible substrate relative to the printing area and translating the print-head relative to the printing area in the direction parallel to the feed direction of the flexible substrate, and wherein the printer includes a print-head which is arranged to be able to be translated in a direction parallel to the substrate advance direction in response to the control signal output from the control unit.

13. The printer of claim 1, wherein the printer includes, for measuring the substrate elongation caused by the tension applied to the flexible substrate between the substrate drive-roll and the substrate tension-providing-roll, first and second encoders which are coupled to the substrate drive-roll and to the substrate tension-providing-roll, respectively, or first and second encoders which are coupled to first and second length-metering rolls which are associated with the substrate drive-roll and the substrate tension-providing-roll, respectively, wherein the first and second encoders are arranged for measurement and comparison of the length of the substrate as metered by the substrate drive-roll and as metered by the substrate tension-providing-roll, respectively, and wherein the measurements of the first and second encoders are output to the control unit where a difference representing a value of substrate elongation in the advance of the substrate between the substrate drive-roll and the substrate tension-providing-roll is computed on the basis of the measurements by the first and second encoders, and wherein the control unit is arranged to issue a command displacing the print-head in a desired direction compensating for the substrate elongation caused by the tension applied to the flexible substrate.

14. The printer of claim 5, in which first and second encoders measure the length of the flexible substrate.

15. The printer of claim 1, wherein the printer is arranged to compare the flexible substrate length to a target substrate advance.

16. The printer of claim 1, in which modifying the defined transport of the flexible substrate relative to the printing area further comprises pulling the flexible substrate a distance that is less than the print head width.

17. The printer of claim 5, in which the first and second encoders determine a gap between a first printed image and a successive printed image.

18. The printer of claim 17, in which a number of gaps between consecutive images is iteratively reduced.

19. A method of printing on a flexible substrate, by means of an inkjet printer comprising:

a print-head for printing on the flexible substrate in a printing area, and a transport and tensioning mechanism for transporting the flexible substrate in a feed direction along a feed-path and applying tension to it, wherein the tension applied to the flexible substrate causes a substrate elongation in the direction parallel to the feed direction, the method comprising measuring the substrate elongation caused by the tension applied to the flexible substrate by the transport and tensioning mechanism, and compensating for the substrate elongation by at least one of modifying the defined transport of the flexible substrate relative to the printing area and translating the print head relative to the printing area in the direction parallel to the feed direction of the flexible substrate, wherein the inkjet printer is arranged to compensate for the substrate elongation by translating the print head relative to the printing area in the direction parallel to the feed direction of the flexible substrate.

* * * * *